United States Patent [19]

Kaenel

[11] 4,302,010

[45] Nov. 24, 1981

[54] ELECTRONIC BOWLING SCORING SYSTEM WITH VIDEO COMMUNICATION INTERFACE BETWEEN MANAGER CONSOLE AND LANE SCORE CONSOLES

[75] Inventor: Reginald A. Kaenel, Weston, Conn.

[73] Assignee: AMF Incorporated, White Plains, N.Y.

[21] Appl. No.: 42,380

[22] Filed: May 24, 1979

Related U.S. Application Data

[63] Continuation of Ser. No. 764,366, Jan. 31, 1977, abandoned.

[51] Int. Cl.[3] ..... A63D 5/04

[52] U.S. Cl. ..... 273/54 C; 340/323 B; 364/411

[58] Field of Search ..... 35/10, 13, 48 R; 235/92 GA; 273/54 R, 54 C; 340/323 B, 734, 745; 364/200, 900, 410, 411; 307/303

[56] References Cited

U.S. PATENT DOCUMENTS

| | | | |
|---|---|---|---|
| 3,565,428 | 2/1971 | Reynolds | 273/54 C |
| 3,774,161 | 11/1973 | Chambers | 364/200 |
| 3,889,253 | 6/1975 | Ross | 273/54 C |
| 3,907,290 | 9/1975 | Fisher et al. | 273/54 C |
| 4,004,354 | 1/1977 | Yamauchi | 35/48 R |

OTHER PUBLICATIONS

Popular Electronics; "Altair 8800 Minicomputer, Part 1;" Jan. 1975, pp. 33-38.

*Primary Examiner*—Anton O. Oechsle
*Attorney, Agent, or Firm*—George W. Price; John H. Gallagher

[57] ABSTRACT

An automatic bowling scoring system is disclosed including a central manager's console unit linked in parallel over a plurality of communication buses with a plurality of lane score processors having printing and CRT display monitor units. The manager's console sends commands to the score processors, and thereby gains control over the execution sequences followed by this score processor and modifies its functional sequence. In particular, the manager's console is capable of selectivity controlling the display at any lane pair processor, to cause display of locally generated game score information, or supplementary information developed at the manager's console. The manager's console can also cause the transfer of the locally generated game score information appearing on any monitor to be routed over the buses to the manager's console display monitor.

12 Claims, 8 Drawing Figures

| KEY | FUNCTION | SET | RESET | LIST |
|---|---|---|---|---|
| C | CLEAR | EXECUTE | | CLEAR PENDING |
| R | REMOVE SCORE | EXECUTE | | REMOVE SCORE PENDING |
| | PRINT AT LANE | EXECUTE | X | PRINTERS PRINTING |
| | PRINT AT CONSOLE | EXECUTE | STOP | |
| | SELECT OPEN OR LEAGUE | EXECUTE | ENABLE SELECT | UNIT IN OPEN OR LEAGUE MODE |
| D | DISPLAY LANE NUMBER | EXECUTE | RESTORE TEXT | |
| | DISPLAY ADVERTISEMENT | X | X | UNIT WITH FUNCTION INHIBITED OR ENABLED |
| S | INHIBIT CLEAR | X | X | |
| V | INHIBIT PRINTER | X | X | |
| B | INHIBIT AUTOSEQUENCING | X | X | |
| O | INHIBIT OPEN LEAGUE SELECT | X | X | |
| | BLANK OUT SCREEN | X | X | UNITS IN PARTICULAR STATE OR NOT IN THAT STATE. |
| Z | DISABLE LANE | X | X | |
| | PRACTICE PLAY | X | X | |
| E | POWER UNIT | X | X | |
| U | IDLE LANES | | | X |
| Y | GAMES COMPLETING | | | X |
| | PAGING MESSAGES | ENABLE KEYBOARD | RESTORE TEXT | TEXT DISPLAY |
| | DISPLAY LANE | SELECT LANE | | DISPLAY IMAGE |
| N | DISPLAY LANES IN SEQUENCE | SELECT GROUP OF LANES | STOP SEQUENCING | DELAY SEQUENCE OF IMAGES |

FIG. 7

ELECTRONIC BOWLING SCORING SYSTEM WITH VIDEO COMMUNICATION INTERFACE BETWEEN MANAGER CONSOLE AND LANE SCORE CONSOLES

This is a continuation of application Ser. No. 764,366, filed Jan. 31, 1977, now abandoned.

BACKGROUND OF THE INVENTION

Bowling score devices, both electromechanical and electronic have been proposed and developed for automatically computing and displaying bowling scores. However, the full benefits of electronic score processing can be realized only if all lane score processing units are in communication with a central manager's station. In this way the manager can monitor and control the activity at each lane. A prior art effort in this direction is disclosed in Fischer U.S. Pat. No. 3,907,290.

Fischer discloses a bowling scoring system wherein a central control unit controls the computing and display of game scores at all lanes. The processor of a central unit communicates through an interface with the memories at each lane pair console so that they serve as the memory for the central processor. Each lane pair console, in addition to the lane pair memory, has a character generator for driving a CRT display and keyboard and automatic pin sensor inputs. The only display at each lane is a CRT display. A single central printer is located at the central processor. The central processor has no game score data memory of its own. No game score processing can occur at any lane. Therefore, the system has the limitation that score processing and display at each lane must await its shared time at the central processor. Further, since a single printer is located at the central processor, printing is also delayed. It has been found that this seemingly simplified approach results in a scoring system which is unnecessarily expensive to build and maintain because of the redundancy which must be provided at the central processor both for processor and printer lest the entire system break down with the failure of any single component at the manager's station. Moreover, no specific means are disclosed for transferring video display material between the manager's console and the lane score processors, to maintain the manager's communication with and supervision over individual lanes.

A similar earlier effort is disclosed in Walker U.S. Pat. No. 3,700,236, which discloses a system having a single computation means for a plurality of lanes, each lane pair may be selectively set for open or league mode of bowling. All computation is carried out at the single computation center, with the computed score results being transmitted to a printer at each lane. This system suffers from the same deficiency of centralizing all score processing at a single central unit with its attendant delays in processing and the risk of a breakdown of the entire house with any failure at the manager's station.

SUMMARY OF THE INVENTION

The subject invention comprises a manager's console for a bowling establishment which provides administrative control over individual scoring consoles provided at each lane pair. The manager's console communicates with the individual score processing consoles over four communication cable buses by which the console can selectively communicate with any individual score processing unit or all of the score processing units by (1) sending commands; (2) receiving data; (3) sending video signals to be displayed at the CRT monitors at a selected score console; or (4) receiving video signals from a score console instructed to transmit such a signal on the video bus. By the transmission of commands including lane score console address codes, register address codes, command and data codes from the manager's console to any identified score processor unit, the manager is able to exercise supervisory control over the processing functions occurring at any lane. By transmitting a video signal over the communication cable bus, the manager console is able to display messages at any identified score processing console. By sending the proper command word to an identified score console, the manager console is able to cause that console to emit the video display, i.e., the game score data currently appearing on the monitor at that identified lane.

As a result of the provision of these functions, the manager's console exercises supervisory control over the entire bowling establishment. However, because individual scoring consoles are provided at each lane pair, a breakdown in any single scoring console or at the manager's console will not interfere with the continued operation of the bowling establishment. Futher, since the manager'sconsole is fully compatible with the individual bowling scoring consoles, it can be made up from the same components used to construct the individual lane score consoles. The difference in functions can be provided by providing the manager's console with a tailored set of control read only memories programmed to provide the different programming functions to be disclosed herein and which establishes the communication between the manager's console and the individual lane score consoles.

CROSS REFERENCE TO RELATED APPLICATIONS

U.S. Application Ser. No. 711,217, Warner, et al, "Bowling Scorer," now U.S. Pat. No. 4,092,727, disclosing a lane pair computer, and U.S. Application Ser. No. 725,885, Kaenel, "Printer for Bowling Score Computer," now U.S. Pat. No. 4,140,404, disclosing a printer cooperating with a lane pair score computer, are incorporated herein by reference.

BRIEF DESCRIPTION OF THE DRAWINGS

FIG. 7 is a listing of the significant control functions exercised by the manager's console over the lane score processor units.

DETAILED DESCRIPTION OF A PREFERRED EMBODIMENT

Figure 1:
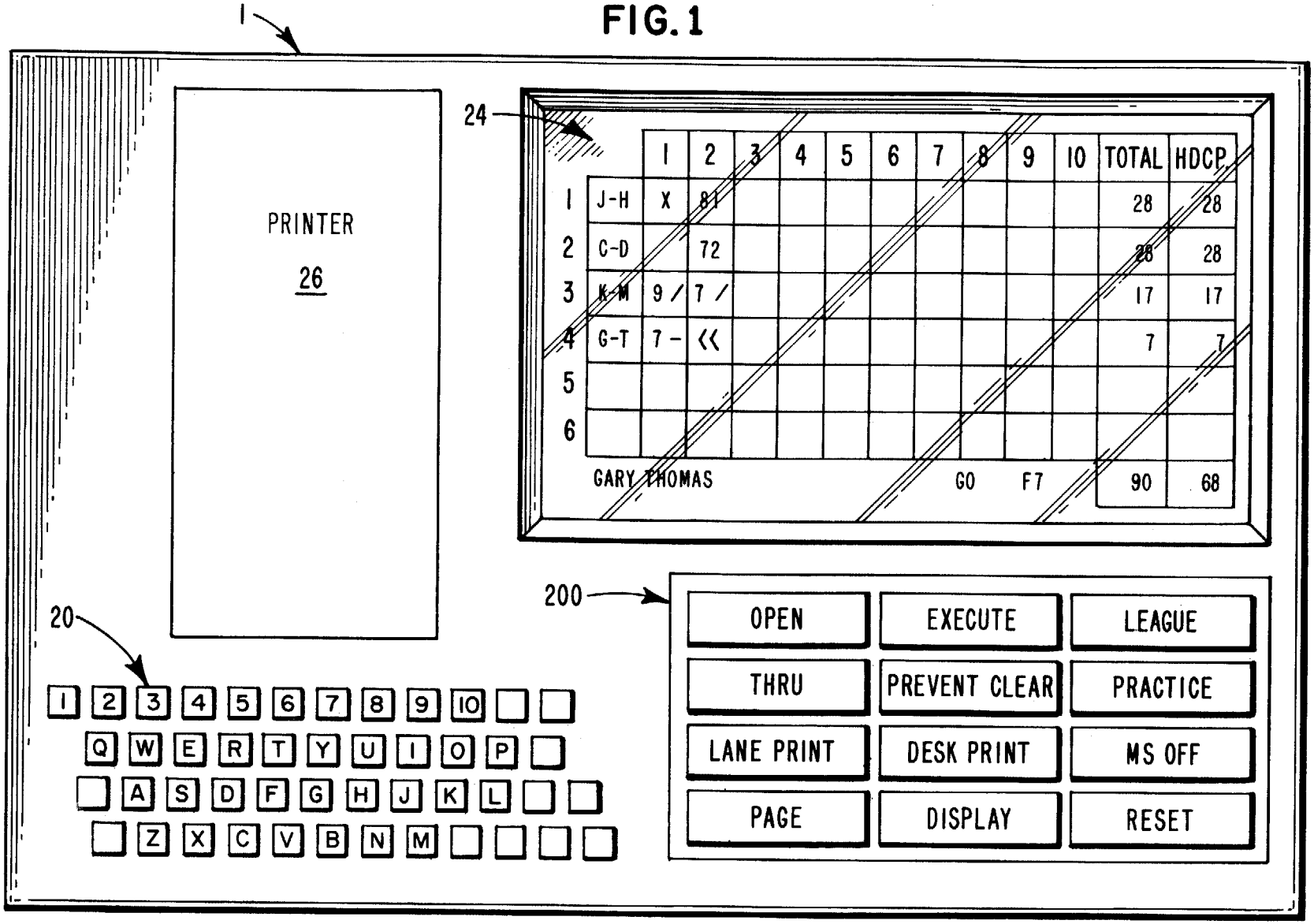
FIG. 1 is a representation of the manager's console including the control keys.
Figure 2:
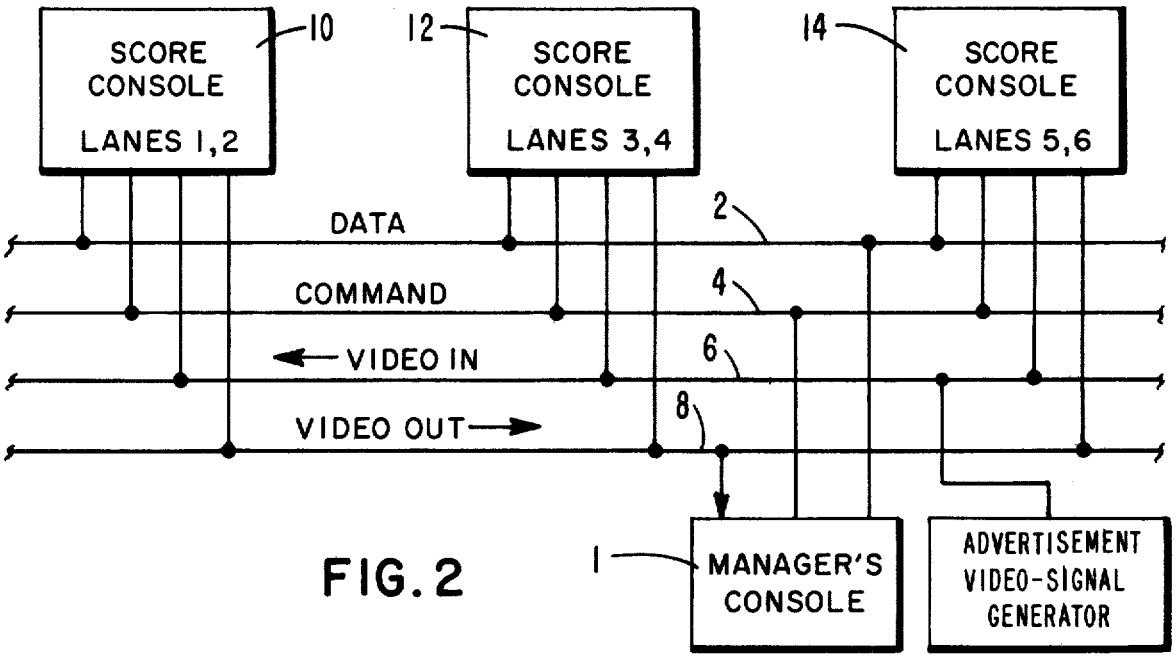
FIG. 2 is a block diagram of the functional relationship of the manager's console with the computer units at the individual lanes.

The disclosed manager's console 1 (FIG. 1) for an automatic scoring system provides administrative control over a plurality of scorer consoles for the bowling proprietor. As shown in FIG. 2, the manager's console 1 is connected in parallel over four communication buses 2, 4, 6, 8 with all the score consoles 10, 12, 14 of the bowling establishment. The manager's console communicates over these buses as follows:

1. The console 1 transmits commands including the identity code of a designated console to the scorers 10, 12, 14 on the command cable 4;
2. It receives data from the addressed scorer 10, 12, 14 instructed to transmit data on the data cable 2;
3. It receives the video signals from the scorer 10, 12, 14 instructed to transmit such a signal on the VIDEO OUT cable 8; and
4. It causes the transmission of video signals to the addressed scorer console 10, 12, 14 on VIDEO IN cable 6.

The score processing units of the scorer consoles 10, 12, 14 communicate over buses 2, 4, 6, 8 as follows:

1. They receive commands (including score console identification codes, command or instruction codes and data codes) on bus 4 in 8-bit long bytes;
2. They transmit 8-bit long data words on bus 2 to manager's console 1;
3. They transmit the video signal of their monitor displays 24L, 24R through a video interface switching circuit (30, FIG. 3) over video cable 8 when instructed to do so by the manager's console 1; and
4. They display on their monitors 24L, 24R a video signal supplied over video cable 6.

It should be understood that three lane consoles 10, 12, 14 are shown only for purposes of example; as many as 49 lane consoles have been successfully used with this system.

Figure 3:
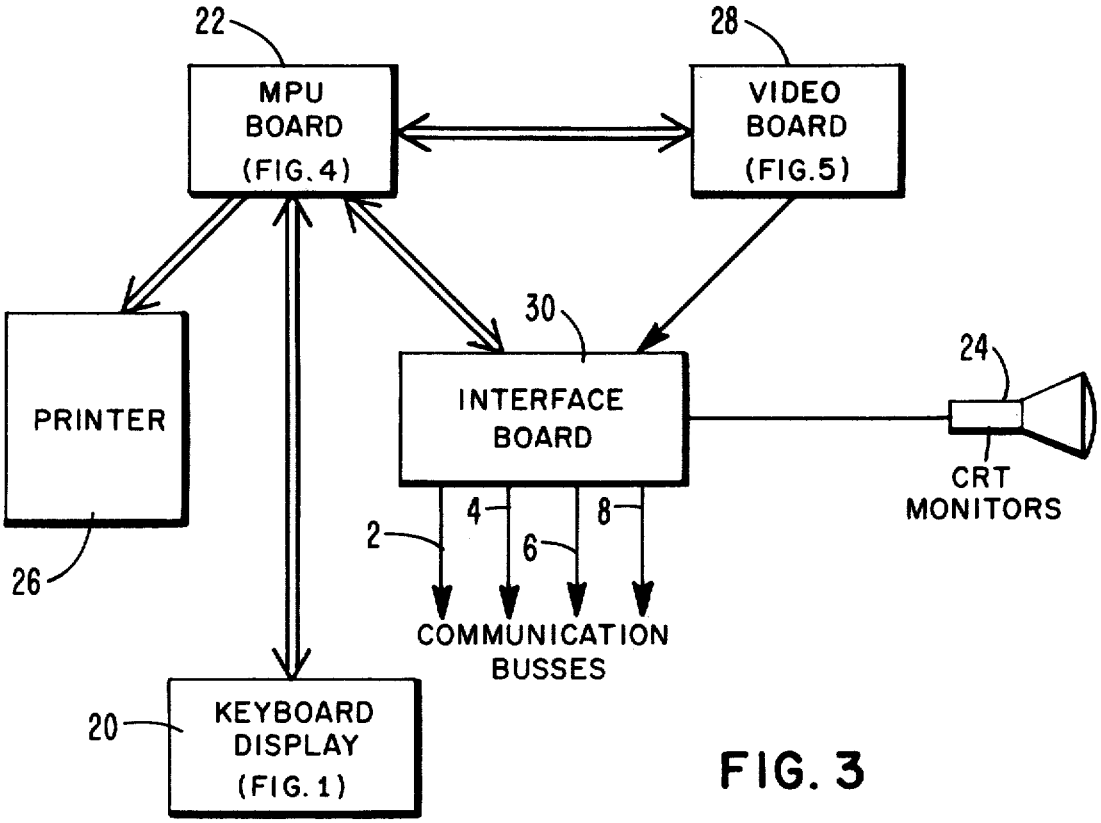
FIG. 3 is a block diagram of the processor components, common to both the manager's console and the lane pair score processors.

As shown in FIG. 3, the manager's console 1 includes a keyboard 20 by which control commands can be intiated and data inserted into the unit; a microprocessor (MPU) board 22 which operates on the commands and information; a cathode ray tube monitor 24 by which the console 1 communicates with the operator and on which the display of a CRT monitor 24L, 24R of any lane score console 10, 12, 14 can be made to appear; a printer 26 by which the score sheet from a lane governed by any score processing unit 10, 12, 14 can be produced; a video board 28 for providing display signals to the CRT monitor; and an interface board 30 for connecting the processor board 22 and the monitor 24 of the manager's console 1 with the processor board 22 and display monitors 24 of any bus connected lane scoring console.

Each lane scoring console 10, 12, 14 includes the same electronic components as included on the manager's console 1. Lane console 10, 12, 14 differ from the manager's console 1 only in having a different keyboard; a differently programmed read only memory controlling the microprocessor board 22; and a second CRT monitor 24 so that the game score information on each lane is displayed on a separate monitor.

Figure 4:
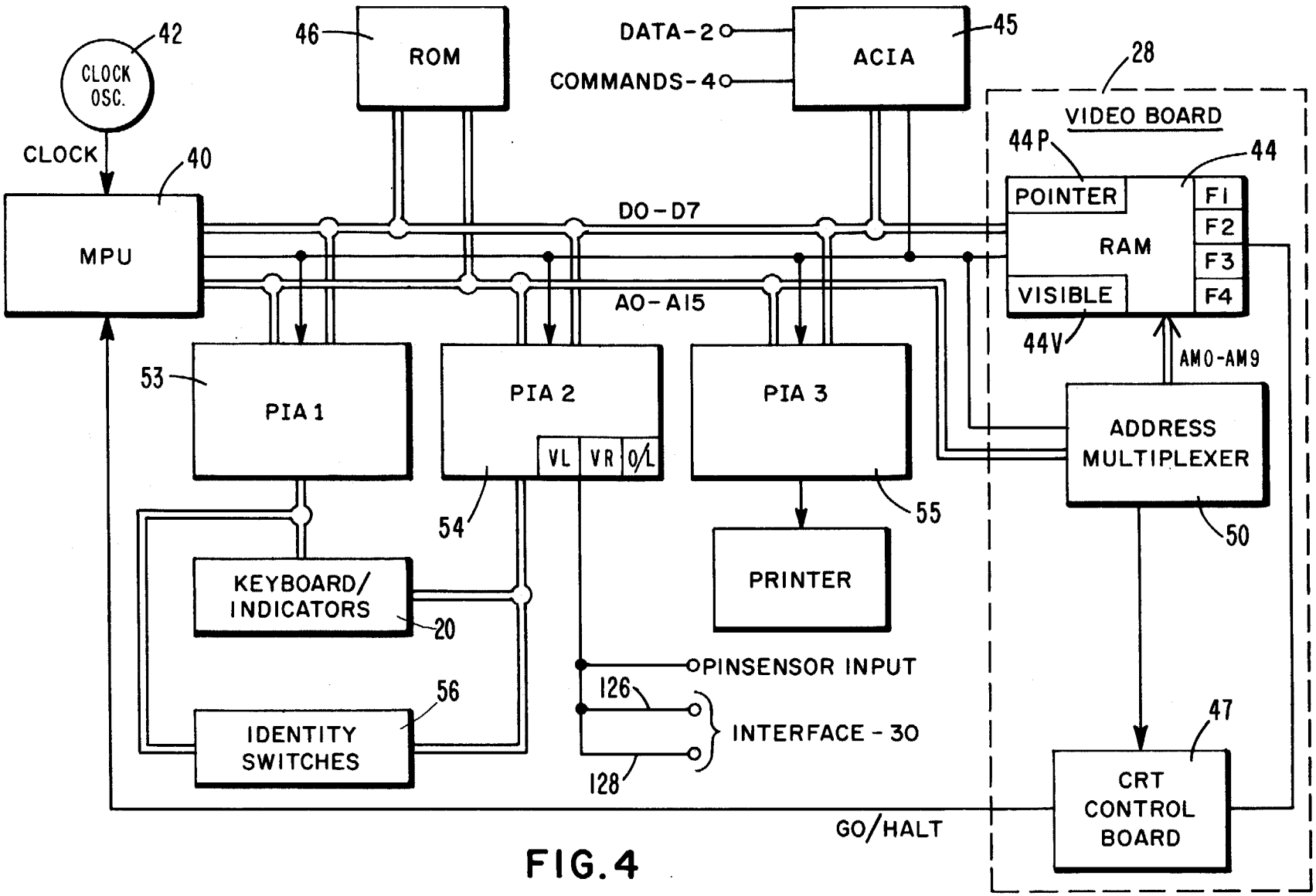
FIG. 4 is a block diagram of the significant elements of the microprocessor control board and video display board of FIG. 3.

FIG. 4 shows in block diagram form the cooperative relationship of the essential elements of the microprocessor board 22 and video board 28 located in the manager's console 1 and each lane pair score console 10, 12, 14. Each console includes a microprocessor 40 which is a Motorola MC6800 whose timing is controlled by a clock oscillator 42 connected through suitable pulse shaping networks to appropriate microprocessor inputs. Data is transmitted to and from this processor through ports connected to a data bus D0–D7. The addresses of the devices which are to receive the data or from which data is to originate, are generated through the "A" ports of the microprocessor, which ports are connected to an address bus A0–A15. A read/write signal on a CONTROL line controls whether the devices are to receive or send data. And the enable strobe on a control line indicates when the signal levels on address lines, data lines, and read/write lines are stable, can be interpreted by the devices attached to these lines, and therefore are to be executed by these devices.

The data to be processed by the microprocessor 40 is stored in the random access memory RAM 44 and is transferred over lines D0–D7.

The same data transfer lines D0–D7 also carry the incoming command words in 8-bit long bytes from the asynchronous communication interface adapter ACIA 45. The ACIA device 45 is a Motorola MC6850 receiving inputs in serial form from bus 2 over input port B which is located on the interface board 30. The input information is transferred on to the processor unit in 8-bit parallel form. Output information is transferred from the microprocessor to the ACIA, in 8-bit parallel form, and converted to a serial format for transfer over the outgoing bus 4. At the lane score processors, input information comprises command words received over bus 4, and output information comprises data words sent out over bus 2. The bus connections are reversed in the manager's console; bus 2, carrying data words, is connected to the input of the ACIA device 45; bus 4, carrying command words, being connected to the output of the ACIA device 45.

The controlling program for each console microprocessor 40 is stored in the read only memory ROM 46 addressed over address lines A0–15; the commands are supplied to the microprocessor 40 over data lines D0–D7. The program for the lane score processor computes for display and printing purposes, individual and team game score data on a frame-by-frame basis in accordance with principles well known in the bowling art. For a more complete description, see the Kaenel application incorporated herein by reference.

The program for the manager's console 1 controls the bus communication between the manager's console 1 and each lane score console 10, 12, 14. The functional behavior of any addressed lane score console 10, 12, 14 can also be controlled from the manager's console. The functions will be discussed below, especially with respect to the control of the video display at the individual lane score consoles and the manager's console.

Each manager's console 1 or lane scorer 10, 12, 14 has a random access memory 44, located on the video display board 28. It is accessed via an address multiplexer 50 and transmits its data back to the microprocessor unit 40 over lines D0–D7. The CRT control board 47 (to be explained in detail in describing FIG. 5) which is the major element of the video display board 28, accesses the random access memory 44 via the address multiplexer 50 to derive the data to be displayed on the left and right lane CRT monitors 24L and 24R (FIG. 5) which constantly display left and right lane game score information. The CRT control board 47 is connected by a GO/HALT line to the microprocessor to interrupt the operation of the microprocessor at regular intervals when the random access memory 44 is being accessed by the video board to transfer a line of data for display purposes. This halt function is necessary to avoid contention problems between the video board 28 and the microprocessor 40.

Data is routed to and from peripheral devices through peripheral interface adapters (PIA) 53, 54, 55. These adapters 53, 54, 55 are connected to the address bus A0–A15 and to the data bus D0–D7 to communicate with MPU 40. Each PIA 53, 54, 55 is a Motorola MC6820 which reeives signals on the address bus from the microprocessor MPU 40 and includes a plurality of output lines for transmitting signals to the addressed peripheral units. The PIA includes a plurality of registers capable of holding a PIA output line high or low for an extended period. Thus, in response to a brief input signal, an output signal can be established to control a desired function as, for example, lighting an indicator light at the keyboard and display panel 20.

PIA 3, 55 is dedicated to the thermal printer to print the game score information as fully disclosed in the referenced Kaenel application.

PIA 2, 54 is used for a multiplicity of different purposes. For one, it drives the "open/league" indicator lights (i.e., CA2 terminal) and stores in a register the "open/league" flag which is used by the program to control various sequences. Also, the communications channel with the pinsensor terminates at this PIA 54. Furthermore, mode selection signals are tested by it (i.e., automatic/manual modes, printer enabled signal, printer fail). One port of PIA 2, 54 is used to control a status indicator light at indicator panel 20 which is made to flash if the lane score console unit has not been used for three minutes; it remains on when the game reaches the ninth frame.

One port is used to energize identity switches 56 by which each lane score console unit is given a distinct address; the program can interrogate these switches to determine if a command code at the manager's console is addressed to it. The results of such an interrogation operation are read by the ports of PIA 1, 53. One port of PIA 2, 54 is used to control the interface 30 (FIG. 3) which the video signal of the lane score console display monitor can be applied to the manager's console video bus 8.

Eight ports of PIA 1, 53 in combination with eight ports of PIA 2, 54 are used to scan a matrix of keyboard crosspoint contacts on keyboard 20. These ports are usually set to the high-impedance input mode. Sequentially, one at a time, these ports are temporarily switched to the low-impedance output mode during the scan sequence and a low signal level is applied to them when they are in this mode. Contact closures of the keyboard are detected by the ports of PIA 2, 54.

The use of PIA devices 53, 54, 55 and ACIA device 45 in combination with a microprocessor 44 is fully disclosed in the manual "M6800 Microprocessor Application Manual", copyright Motorola Inc., 1975, available from Motorola Semiconductor Products Inc.

The specific commands to be addressed to the PIA's 53, 54, 55 in the operation of this invention will be discussed in detail below.

Figure 5A:
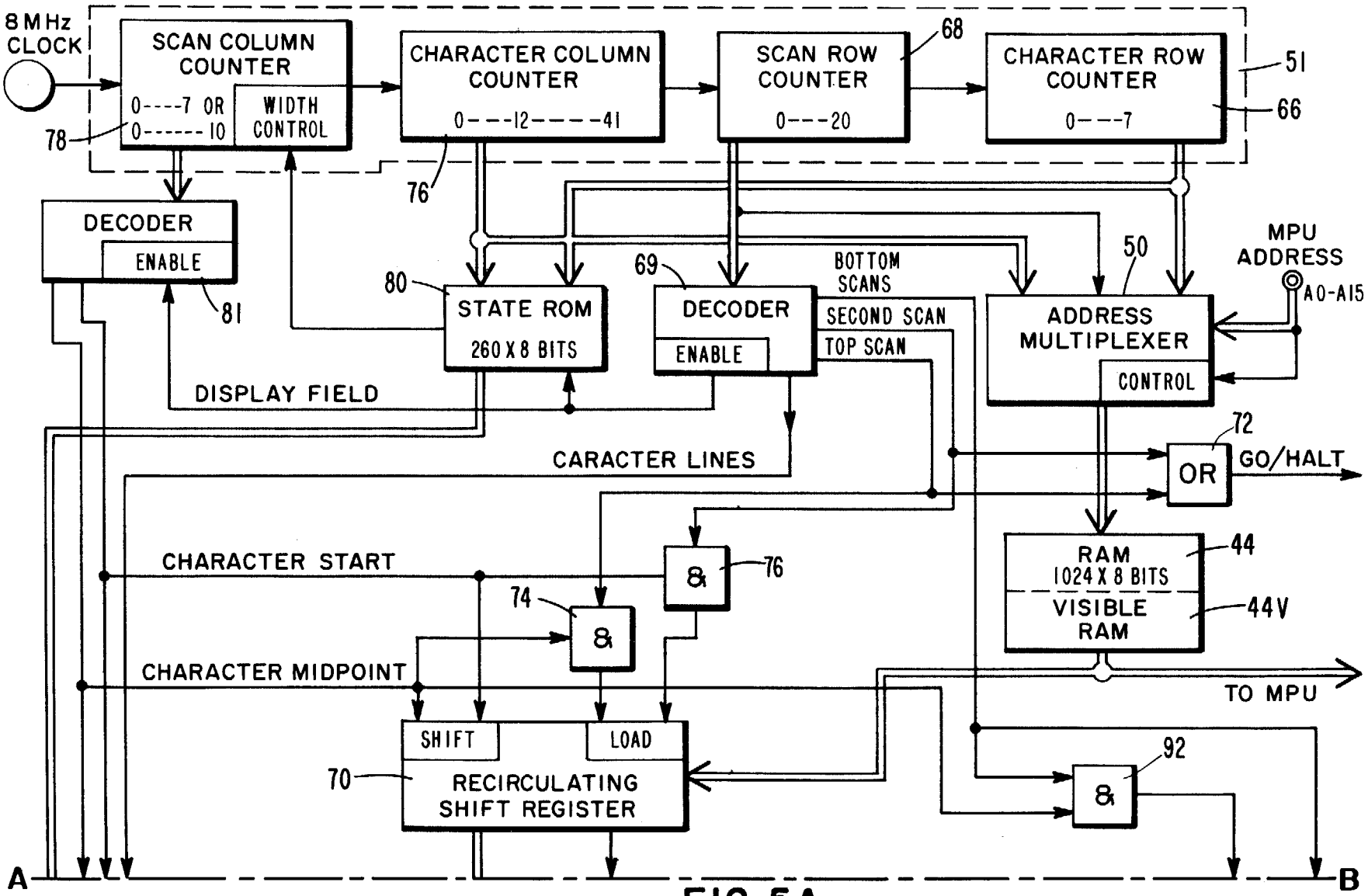
FIG. 5 which comprises FIGS. 5A (the top half of the composite) and FIG. 5B (the bottom half of the composite) is a block diagram of the video display control board of FIG. 3.
Figure 5B:
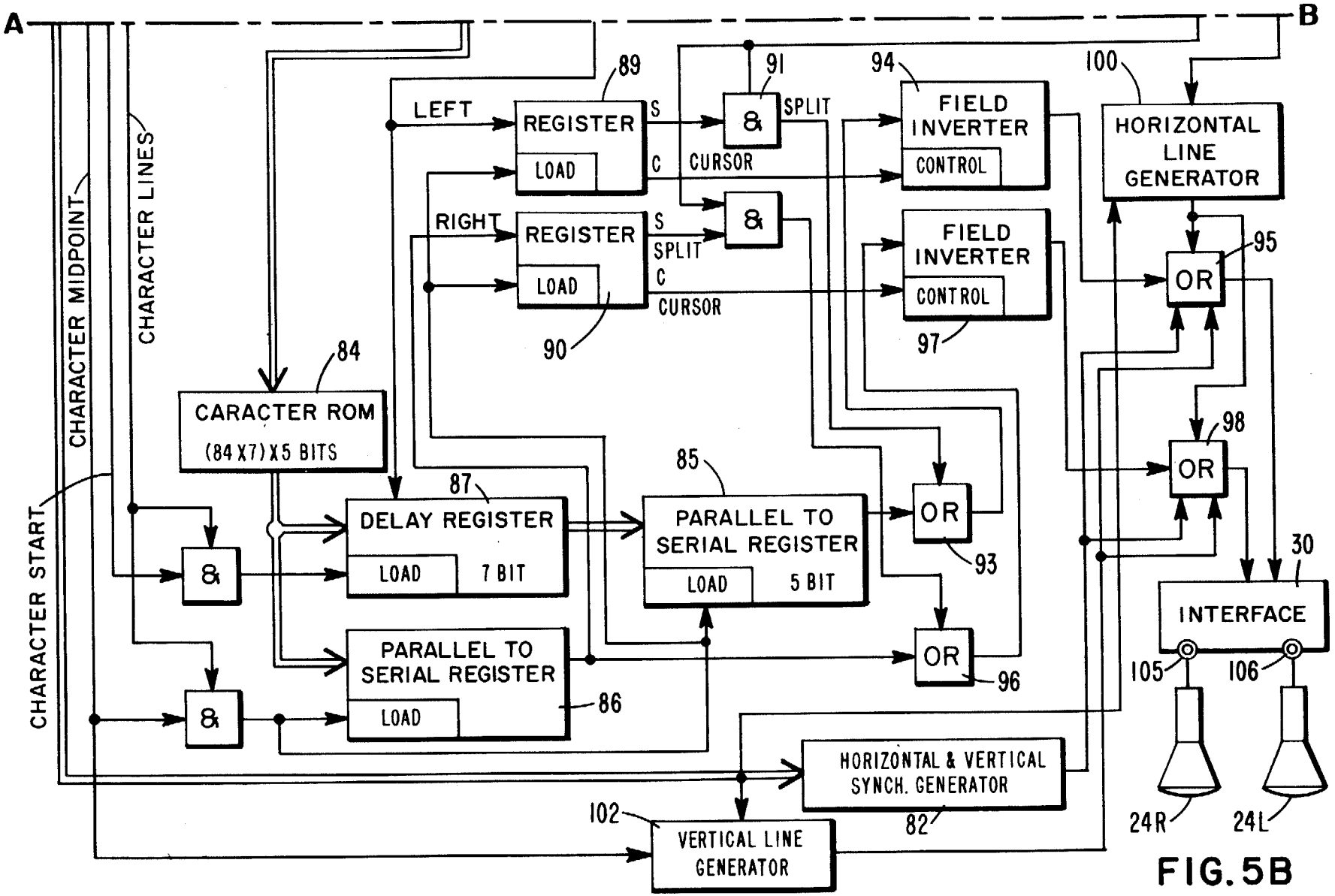

The CRT control board 47 of video display board 28 is shown in FIG. 5, which comprises two portions 5A, 5B; FIG. 5A should be placed above FIG. 5B. By means of this board, a selected area of the random access memory 44 identified as VISIBLE RAM 44V which stores the identification of each player, each player's game, frame by frame, and total score information is repetitively accessed. All the information stored in area 44V is displayed on the monitors 24.

The random access memory 44 is addressed through an address multiplexer 50. The same random access memory 44 stores the data to be operated on by the microprocessor 40, which also uses multiplexer 50 for addressing. The CRT control board 47 includes means for addressing the random access memory 44 without interrupting the microprocessor 44 comprising clock controlled counter 51. In order to avoid a contention problem with both the microprocessor 40 and the CRT control board 47 simultaneously attempting to access the random access memory 44 through the same address multiplexer 50, a GO/HALT line is provided from a counter controlled decoder 69 to the microprocessor 40 which interrupts the microprocessor 40 on a regular schedule (8 MHZ rate) when the random access memory is being accessed by the CRT control display board 47.

The operation of the CRT control board shall be briefly described below; its construction is simplified by the fact that the CRT display has only two levels, black and white. This consideration also simplifies the design of the important feature of this invention, i.e., the interface (30, FIG. 5B) by which the output signals defining the CRT display normally appearing on the left and right monitor 24L and 24R are selectively decoupled from these monitors and applied instead to the video out bus 8 via the video interface circuitry of FIG. 6.

The CRT control board 47 includes a clock controlled counter 51 having four separate counters therein for accessing RAM 44 and locating the data characters stored therein defining each player's game and frame score information on the monitor 24. It can be seen from FIG. 1 illustrating the display of a typical CRT monitor 24 at the manager's console 1, that a complete display for one lane includes eight rows of characters. A top or heading row includes the name of the team and the number of each frame being bowled as well as total and handicap headings. The next six rows are for the display of the game scoring information of the six possible bowlers on a lane. The eighth row names the player who is presently bowling on the displayed lane, the number of games and frames already bowled on the lane, and the individual and team running scores and totals. At a lane score console the displays for the left and right lanes appear on separate left and right monitors 24L and 24R. The character data for the two displays is stored in alternating positions in RAM 44. Thus, by alternately shifting out characters to separate registers, as discussed below, both left and right displays are produced by a single control board 47.

The eight rows of a display are counted by the character row counter 66. As the character row counter 66 counts through the eight character rows, row by row, signals are applied thereby to the address multiplexer 50 which accesses the random access memory 44.

Thus, as each row is completely displayed, the eight rows of a display are counted by the character row counter 66. As the character row counter 66 counts through the eight character rows, row by row, signals are applied thereby to the address multiplexer 50 which accesses the random access memory 44.

Thus, as each row is completely displayed, the next row of characters in RAM 44 is addressed for transfer. Each of the eight rows of a CRT display is broken up into twenty horizontal scans. Data transfer from the random access memory 44 to the recirculating shift register 70 occurs during the top and second scan of each character row. These scans are counted by the scan row counter 68. The output of the scan row counter 68 is applied to a decoder 69 having a repetitive output which develops the signals shown to transfer each character display row from the random access memory 44 to a recirculating shift register 70.

It can be seen that the outputs of the decoder 69 during the top and second scans are applied to an OR gate 72 to apply a signal to the GO/HALT line to the microprocessor 40 to halt its operation. For the duration of this signal, the character row counter addresses the random access memory 44 through multiplexer 50, and the microprocessor 40 cannot interfere. The same top scan and second signals are applied through AND gates 74 and 76 to the load control input of the recirculating shift register 60, causing a row of characters to be inserted in the shift register from RAM 44.

Each row of game score information on the screen includes space for 41 characters. These characters are counted by the character column counter 76. The width of each character varies from 7 to 10 counts, depending on its location on the display, i.e., a character adjacent a vertical line has a higher associated counted width, to allow space for the line. The count is provided by the scan column counter 78 and is changed from 7 to 10 by a signal from the state ROM 80 which stores the over format of each line of characters. Format signals are transmitted on the output line from the state ROM 80 to the horizontal and vertical sync generator 82 to provide the necessary sync signals as the beam scans across the screen. The associated state ROM 80 is in effect a redundant decoder in the sense that different addresses have the same output so that the format assigned to each character frame and each row can be efficiently stored.

The decoder 81, connected to the output of the scan column counter 78, provides two signals, CHARACTER MIDPOINT and CHARACTER START to AND gates 74, 76, which receive as the other input thereof the top scan and second scan signals from decoder 69. These gates 74, 76 provide two successive load signals and two successive shift signals during the top and second scans of each line of characters; this arrangement is necessary because the character data for each line on the left and right monitors 24L, 24R is interlaced on a character-by-character basis in the random access memory 44. That is, the first character for the left-hand monitor is followed by the first character of the first line on the right-hand monitor and so on. Therefore, the characters for the left-hand monitor 24L are first shifted out of the random access memory 44 into the recirculating shift register 70 and then the characters for the right-hand monitor 24R.

Each row of characters is converted sequentially through a character dot ROM 84 into a sequence of display dots during a beam scan. The binary information necessary to display each character is provided by the character read only memory 84 as each character is read out of the shift register 70. A different line of dots is produced for the same row of characters stored in each register 85, 86, depending on the scan line in a displayed row. Thus, the character ROM 84 is also a decoder for outputting the binary beam modulating signals necessary to define each character on the screen.

The beam modulating signals from this read only memory 84, if for the left-hand screen, 24L are stored in a 7-bit delay register 87. The data representing the following character in the recirculating shift register 70, which is to appear on the right-hand monitor 24R, are loaded directly into a parallel to serial register 86. As this register 86 is loaded, the delay register 84 shifts its storage bits to the left-hand monitors parallel to serial register 85. Use of delay register 87 allows the display on both the left- and right-hand monitors to be controlled using a single sync generator 82.

In each 8-bit character word, two bits have special significance. A single significant bit determines whether the character to be displayed shall be a cursored character. If so, the character appears on the monitor on an inverted field, i.e., as a black character on a white background rather than a white character on a black background. A second significant bit is dedicated to indicating that a split has occurred when the indicated pin fall was achieved. If so, a short vertical line is displayed under the middle of the character. Each of these bits enable lines loading into registers 89 and 90. The output of the register 89 when a split bit is detected is combined via an AND gate 91 with the character midpoint signal and bottom scan line signals received from AND gate 92 to properly combine the split indicating vertical dot line; and these character dot signals are combined with the character dot output of register 85 at OR gate 93.

If the character is to be cursored, then the output on the C line of register 89 activates the CONTROL input of field inverter 94, and the character dot output from register 85 via OR gate 93 is inverted by field inverter 94. The output of this field inverter then is combined at OR gate 95 with sync signals from generator 82, and transmitted via interface 30 to port 106 and monitor 24L. The right monitor's video data signals are transferred from register 86 through OR gate 96 (which adds the split display signals) to field inverter 97 where the display field is inverted by the presence of a cursor signal C from register 90. The output of inverter 97 is transferred through a multiple input OR gate 98 to interface 30, port 105 to monitor 24R.

The other inputs to multiple-input OR gates 95, 98 are signals from the horizontal and vertical line generators 100, 102 which draw the background grid on the screen. The horizontal and vertical line generators 100 and 102 are controlled directly from the decoder 82 based on signals received from the state read only memory 80 and the count from scan column counter 78.

All of this disclosure is as a background to demonstrate how the serial, binary signals are developed to place information stored in a lane score console random access memory 44 on the left- and right-hand monitors 24L and 24R. The same type of CRT control board is located at the manager's console 1; the CRT monitor at console 1 is connected to one video port 105 or 106, with the other port left in air. Since the video signals to each video port comprise only a sequence of binary information, an interface 30 has been designed to transmit the video from any lane monitor 24L or 24R to the manager's console CRT 24. This invention is particularly concerned with means for taking the display off either monitor and transferring it over VIDEO OUT bus 8 to the display of the manager's console 1. Alternatively, on appropriate command, the manager's console is able to put its own display directly on the face of monitor 24L and 24R, replacing whatever game score display normally appears thereon under the control of CRT control board 47. The means by which these functions are accomplished is included in the interface shown in detail in FIG. 6.

Figure 6:
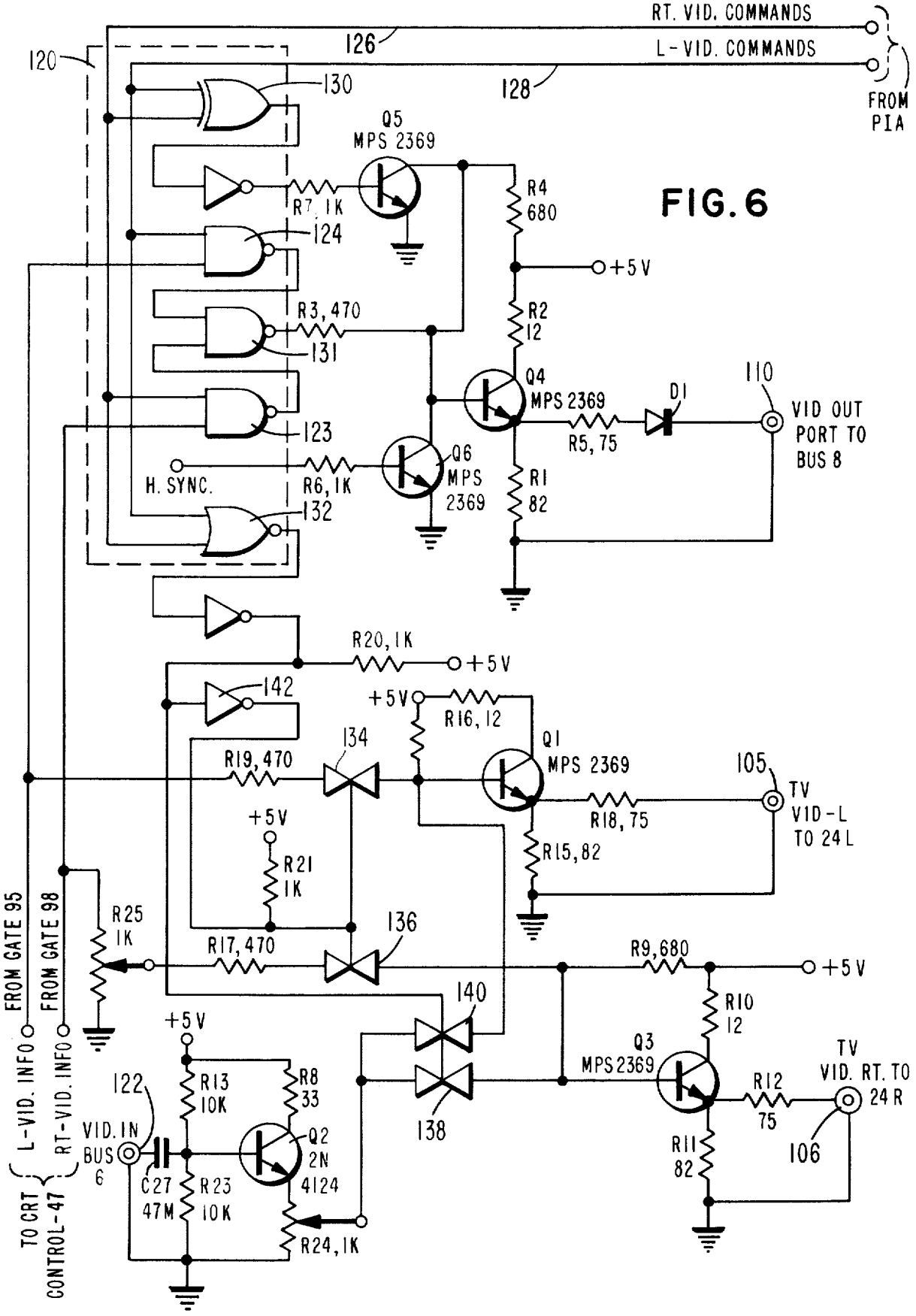
FIG. 6 is a detailed schematic diagram of a portion of the interface between video input/output parts of each processor.

FIG. 6 shows the video switching circuit interface board 30 in detail including the connections to buses 6, 8. The other buses, the command cable 4 and data cable 2, are directly connected to the ACIA device 45 shown in FIG. 4 for transmitting commands to the microprocessor and receiving data words back from the microprocessor.

The discussion below describes the function of the interface board at a lane pair score processor 10, 12, 14. The bus connections would simply be reversed at the manager's console 1.

The VIDEO OUT cable 8 which transmits the information from a lane monitor at an addressed console back to the manager's console 1 (FIG. 1) for display on that console's single monitor (FIG. 1) is connected to a VIDEO OUT PORT 110. This VIDEO OUT PORT 110 receives either the left or right video information as determined by the video selection gating system 120 to be described in detail below. The gates of the video selection means 120 are enabled by commands transmitted from the manager's console 1 (FIG. 1) to the lane score microprocessor 22 of the addressed lane score console. The switching does not affect the continued game score display on the local monitor.

Alternatively, where the manager's console wishes to display information on the lane score consoles left and right video monitors 24L, 24R as, for example, advertising information, this information is transmitted directly to the VIDEO IN PORT 122 over VIDEO IN bus 6. Interface circuitry 30 also includes gates for cutting off the video normally received by the left and right monitors 24L, 24R from CRT control board 47 of video board 28, so that the monitors 24L, 24R display video from the manager's console 1 arriving on bus 6 at port 122 in place of the video locally generated. These gates are also responsive to commands from the manager's console. The means for transmitting these commands is disclosed in detail below.

As shown in FIG. 6, the left video information and right video information arriving at interface 30 from gates 95 and 98 is normally applied to driver transistors $Q_1$ and $Q_3$ and thereby to ports 105, 106 for display by monitors 24L, 24R.

The video selection means 120 functions as follows. When the manager's console orders video information from one of the two video monitors 24L, 24R at a lane score console transmitted back to the manager's console monitor 24, a command is transmitted (as shall be described in detail below) to the lane scorer's microprocessor 40. This microprocessor addresses a control register in the PIA2, 54, and sets a bit therein, establishing a listing signal on the appropriate command lines 126, 128. For example, if a signal appears on command line 126, ordering transmission of the right video normally on monitor 24R, back to the manager's console, then the AND gate 123 is enabled. This gate 123 is now going to pass the right video information currently being displayed on the right video monitor 24R through the gate 131 and via the driver transistor $Q_4$ to the video output port 110 and out over video output bus 8 without interfering with the display on monitor 24R.

Alternatively, if the left video is desired at the manager's console monitor 24, the appropriate command to MPU 44 causes it to set a bit in the control register in the PIA 2, 54 to establish a signal on the left video command line 128 which is applied to gate 124. Thus, gate 124 has the left video information applied to the other input thereof. This video information will now be transmitted via the gate 131 to driver transistor $Q_4$ and out the video port 110. In either case, appropriate horizontal sync signals are added to the outgoing signal via transistor $Q_6$. The outgoing video via gate 131 is a two-level signal, i.e., +1 and/or 0. The added sync signal is at a −1 level, and must therefore be added beyond the last logic gate. Gate 130 is an exclusive OR gate which pulls the VIDEO OUT port 110 to ground in the absence of a command or in the presence of both commands on lines 127, 128, to prevent spurious transmission, especially of the H SYNC signal.

OR gate 132 is provided to implement a third alternative, i.e., that the manager's console commands the display on monitors 24L, 24R of information transmitted from the manager's console on bus 6. To carry out this function, it is not only necessary to apply the information from bus 6 via port 122 to left and right video ports 105, 106; it is also necessary to cut-off the normal video information from gates 95 and 98. This is done by transmitting commands from the manager's console to the microprocessor 40 to set register bits requiring transmission of both the left and right video. On transmission of an appropriate command to the lane score units to display the information on bus 6 on the left and right monitors 24L, 24R, the microprocessor addresses both the registers in the PIA 54 to set bits establishing a signal on both command lines 126 and 128. This results in command signals being applied to the OR gate 132 and exclusive OR gate 130.

The exclusive OR gate has a zero output just as it does on no command signal. Thus, VIDEO OUT port 110 is held at ground by transistor $Q_5$, and no monitor information is sent out port 110 on bus 8.

It is only in the presence of a signal on both command lines 126, 128 that the output of OR gate 132 changes state. In this instance, when both commands are present, the output of OR gate 132 applied via inverter 142 to multiplexer gates 134, 136, closes both gates, cutting off the normal video from gates 95, 98 to the left and right monitors. The result is that no further information can be transmitted to the left and right video ports from the local CRT control board 47 (FIG. 3). Simultaneously, multiplexer gates 138, 140 are opened by the signal from gate 132; thus, the signal received over bus 6 at port 122 and amplified by transistor $Q_2$ is applied to monitor amplifiers $Q_1$ and $Q_3$ and appears at ports 105, 106 on monitors 24L, 24R.

The description above applies to the operation of the lane score processors. At the manager's console, the same CRT control board 47 (FIG. 5) and video interface 30 (FIG. 6) are used. The single monitor 24 is connected to either the left or right port 105 or 106. However, bus 8 is now connected to port 122; and bus 6 which carries video to the lane score processors 10, 12, 14 is connected to port 110. Alternatively, bus 6 may be connected directly to a TV camera and video amplifier, the TV camera being normally directed at an advertising display. The amplifier could include an AND gate having an enabling line connected to a PIA port; the gate would be opened when the register connected to the PIA port has a bit set by the manager's console microprocessor.

As to the commands, establishing a signal on both command lines 126, 128 at the manager's console blanks out the local display and puts the display from the selected lane score processor on the monitor 24.

Communication of commands from the manager's console 1, FIG. 2, to each lane score processing units 10, 12, 14, is in the standard asynchronous code format. Four code types are defined by using identifying bits in the last significant bit positions. The microprocessors immediately recognize these bits to identify the code type being received. This enables the manager's console to communicate effectively with any one or more of the lane score processing units. First, a unit address code is transmitted on the command bus 4 which is identified by the two least significant bits being 01. If the manager's console is addressing all lane score units, the 6 most significant bits are all ones. If a command is being sent that instructs the scorers to disconnect all video signals from the video cable 6, then the six-bit address consists of all ones except for the least significant bit.

A lane score processing unit 10, 12, 14 recognizes that it is being addressed by accepting and storing each address code received on the command bus. It first tests to determine if either of the 6 address bits consist of all ones or all ones except the least significant bit. In either case, a flag bit is stored in a predetermined register in the random access memory causing the MPU 40 to recognize that it must process the next command on bus 4.

In the case where an individual lane score processor 10, 12, 14 is being addressed, a unit recognizes its own individual address by comparing the 6-bit address code to an address which is established manually on an array of six selectable switches 56 located on the MPU board 40, FIG. 4. These selectable switches 56 are connected between ports on the PIAs 54, 53; the ports are addressed in turn and a comparison routine is carred out by MPU 40 to determine if the address code received does in fact match with the address code established on the selectable switches 56. If there is a match, then a flag is set in a register in random access memory 44. The addressed score processing unit will then accept, store and operate on the basis of the succeeding command words received in its ACIA 45 over the command bus 4 from the manager's console 1.

These codes consist of (1) a memory pointer code which will identify the register in random access memory 44 which stores the data on which the lane score processing unit is to operate or the PIA register to be addressed. Next (2) is transmitted a control code which will tell the microprocessor exactly what operation is to be performed, e.g., set or reset a bit. Finally (3) is sent a data code which will identify by the significant bits included in the code which bit locations in the register identified by the memory pointer code are to be operated on. Each of the command words, be it a memory pointer code, a unit address code, a control code, or a data code is transmitted in a format of 8 bits equal to one byte, to be compatible with the structure of the disclosed system which operates on 8 bit format codes.

The type of code being transmitted is identified by the state of bits in the least significant bit positions of the 8-bit byte. Thus, for example, a total of 12 bits are necessary to identify each and every one of the available memory locations at the lane score processing unit. These are provided by transmitting the memory code in two successive bytes. A byte wherein the two least significant bits are 00 designates that the other six bits comprise the low order 6 bits of the 16 bit memory pointer. The byte wherein the two least significant bits are 10 includes bit 7–11 and bit 13 of the memory pointer. The other bits of the pointer are automatically considered to be 0.

As pointed out above, the unit address code is identified by the two least significant bits being 01. The other six bits provide the address.

The control code is identified by the three least significant bits being 111. The data code must include eight significant bits of information. Therefore, it is transmitted in two successive bytes. Each data code byte is identified by the three least significant bits being 011. Where the fourth least significant bit is 0, then that byte includes the four bits representing the lower order half byte of data. Where the fourth least significant bit is 1, the other four bits of the data code represent the high order half byte of data.

Each lane score processing unit 10, 12, 14 under control of its microprocessor 40 receives each byte at the input port of the ACIA unit 45 where it is converted to an 8-bit parallel format and transmitted in that form to the microprocessor 40 which acts on the information as follows. Upon detecting that a memory pointer code or a portion of the memory pointer code has been received, the significant bit information which makes up the memory pointer code is deposited in a pre-designated pointer register 44P in the random access memory 44. Then in the course of a program subroutine commanded by the control code, this pointer register 44P will be read to determine the register to be accessed by the processor 40 to carry out the commanded operation. The control code is next received by the MPU 40. The microprocessor 40 sets what are termed control flags according to the command contained in the control code. These flags are bits set in significant bit locations in predesignated registers F1–F4 in random access memory 44 or PIA 2, 54. These designated locations, flag registers F1–F4, each have 8 bit positions. Therefore, 32 flag bit positions are available each of which may be selectively set and tested by different subroutines. For an example of how such bit positions may be arrayed, see lines 24–30 of page 1 of the program in Appendix A.

As a part of the normal processing sequence of the lane control scoring unit, the microprocessor 40 interrupts what it is doing on a regular schedule, e.g., every eight milliseconds, and tests each of these flag register locations. When a flag is detected, the program automatically branches to the subroutine commanded by that flag. Therefore, the control code may be set a flag which designates that the scorer is to receive a data code and use it to modify the bits of the memory location addressed by the content of the pointer register. This may occur for example where the manager's console commands the page mode, i.e., a paging message is to be displayed on the top line of a monitor's display for a given lane. For example, the message might be for the player to call a particular extension number. In order to do this, the manager's console simply transmits the control code which states that the following data words are to be stored in the RAM 44, beginning with the register pointed out by the pointer register 44P and in the following sequence of registers. Once the page message is stored in these registers, which would be located in the "visible" portion 44V of the RAM 44, then these registers would normally be accessed and their contents displayed as a part of the normal operation of the CRT control display board 47.

Alternatively, the command flag may indicate that the microprocessor for the lane score unit is to transmit data from the location specified by the pointer register. For example, the pointer register 44P may designate a register which contains game score data for a particular lane. The command may order that bit of data and all succeeding bits of game score data for the lane sent back to the manager's console memory 44, so that the manager's console 1 can print the score record for that lane. Since the manager's console microprocessor is fully compatible with the lane score processor consoles, being made up of exactly the same type of components and having only a modified controlling program, no modification of the data transmitted back to the manager's console is necessary. It is simply stored in a designated location in the random access memory which is normally accessed by the CRT control display board 47, and placed on the monitor display.

Alternatively, a control flag may be set which indicates that the bits defined by the ones in the data word are to be set. For example, this is a means of setting a flag in register VR or VL in PIA 2, 54 connected to lines 126 and 128, respectively, commanding interface 30 to transfer the selected video display over bus 8 to the manager's console 1. The command may require the resetting of a bit in a particular register location. This would be the case for example where the register VR or VL which in the PIA 54 is used to command video transfer is being reset to end video transfer from the lane monitor 24R or 24L back to the manager's console monitor. Finally, the manager may be testing the bit pattern of a location as for example addressing all the lane score units to test if any have their screens blanked out, and asking that any score unit which has that flag set which causes its screen to be blanked transmit its address back to the manager's console. Thus, the processing at any one or more lane score processing units can be affected and interrupted during the otherwise normal procedures, from the manager's console which thereby exercises full overall control over the scoring functions carried out at each lane score processing units.

In operation, a manager's console function is executed by activating the corresponding key which causes a respective software subroutine to be entered. These keys and the functions which they initiate are shown in FIG. 1. It can be seen that eleven of the functions are initiated by keys so labeled.

The twelfth key is an execute key which is included to allow the manager time to reconsider the executive decision he has made and push the reset button instead of the execute button. For example, to display at the manager's console the display at lane 2, one would push 2—DISPLAY—EXECUTE. To end the display, one pushes 2—RESET—DISPLAY—EXECUTE. Once the subroutine addressed by the keyboard is entered, it transmits a series of codes on the command cable, beginning with the address code that selects the desired lane score unit or units according to the unit number (lane 2) that was first entered from the keyboard and is being displayed on the CRT display panel. Next is transmitted the memory pointer code which designates the memory location of the scorer wherein activity is taking place. (In this case a PIA register VR or VL.) This is followed by the control code which designates the type of activity that the lane score console is to carry out (set a bit in that register). This is followed by the data code which specifies the bits involved in the activity. In almost all cases, a data code is necessary. For example, to command a lane score processor to transmit its video data back to the manager's console, one particular bit in the designated register VR or VL in the PIA 54 must be set. Therefore, after the pointer register carries the address of that video display transfer command register in the PIA; the command carries a code requiring designated bit in that register to be set. Finally, the data code must carry a one in the least significant bit location of the actual data word. This indicates that it is only that bit which is to be set, thereby establishing a command signal on the line 126 or 128 connected to the addressed register.

In the bowling system described herein, many functions are initiated in the scorers by setting particular flags which are interpreted by the scorer's software as they would interpret entries from their own keyboard, for example, clear or print. Other involve requiring the lane score processing unit to read the status of certain flags, that is certain bits in the register selectively addressed by the pointer register (for example, 10th frame light on, open mode, list units inhibit mode). Still others involve storing particular data in selected locations (for example storing a paging message, storing a lane number display). Finally, some functions require the transmission of data from a particular lane back to the manager's console. For example, the manager's console print function is accomplished by transmitting the contents of the locations in random access memory which store a lane's game score data from a lane score processor into the manager's console random access memory. This is accomplished by transmitting the pointer register at the addressed lane scorer the first data location for a given lane for frame 1 of player 1 on a particular lane, and ordering the transmit function for that particular register; and then transmitting in the command code the included order to increment the number stored in the pointer register so that all the registers storing the game score data for an entire lane are sequentially addressed from the pointer register, and each register's contents in turn are transmitted back to the manager's console for storing in corresponding locations in the manager console's random access memory. The manager's console score program includes a printer subroutine for driving its own printer including a routine for calculating the score, and for transmitting it to the printer.

Thus, by transmitting the proper orders from the manager's console to the lane score processing unit, the manager's console is able to modify or interrogate any memory location of a lane score console unit. The manager's console 1 is able to gain control and initiate execution sequences followed by an addressed lane scorer 10, 12, 14 and thus significantly modify the functional sequences followed by the lane scorer. The use of standard components and subassemblies in both the manager's console and at the lane score processing units allows for simplified transmission of data over the buses 2, 4, 6, 8 between the manager's console and the scorer units, without the need to significantly modify the program sequence followed at the lane score processing unit 10, 12, 14 and without the need to otherwise structurally modify the lane score processing unit except to provide the necessary interface 30 between the bus connections which has been disclosed above. No complex data conversion techniques are necessary to provide the communication between the manager's console 1 and the lane score processing units 10, 12, 14 since both follow substantially the same execution sequences and are written using the same instruction set. Thus, a further important advantage resides in the simplified stocking of spare parts and facilitation of maintenance of the manager's console and the lane score processing units. The only difference between the manager's console 1 and the lane score processing unit 10, 12, 14 is a modification of the read only memory ROM 46 storing the program which controls the operation of the microprocessor 40 at the manager's console 1 to incorporate the necessary transmitting command.

The individual lane score processing units 10, 12, 14 include as a normal part thereof an interrupt sequence for checking certain registers designated herein as flag registers to see if a bit has been set in such a register, or to set or reset a bit in a register in RAM 44 addressed by the contents of pointer register 44V. Such a bit serves a jump command to an existing subroutine in accordance with well known programming principles. Such programming principles are specific to the disclosed system are disclosed in "M6800 Microprocessor Programming Manual"; copyright Motorola Inc., 1975 and published by Motorola Semiconductor Products In. and incorporated herein by reference.

The operator's, keyboard which is used to initiate control functions over the lane score processors is shown in FIG. 1 as it appears at the manager's console station. It includes 12 keys labeled to indicate the specific functions they initiate. A standard typewriter keyboard is provided for entering data and information directly into the manager's console memory 44. Some of the alphabetic keys may also be used to initiate functions as shown in the left-hand column of FIG. 7. The numeric keys are used to designate particular lanes. The normal sequence for causing a function to be performed is to designate a lane number, then push the desired function key, then push the execute button. For example, the manager may wish to put lanes 1-10 in the league mode. He would push key 1, the THRU key on the console keyboard, and the 10 key. This would designate the lanes. He would then push the function key LEAGUE. He would then push the EXECUTE key causing the manager's console to address in succession each of lanes 1-10 and transmit to them an address pointer which points at the register which normally stores an open/league flag; a command to set the flag in the addressed PIA register; and a data word having a bit in the bit position corresponding to an indication to the local score processor 10, 12, 14 that the league mode should be followed in carrying out score processing operations.

The available communication functions between the manager's console 1 and the lane score consoles 10, 12, 14 are listed in FIG. 7. The key used to initiate the function may be an alphabetic key on keyboard 200 (FIG. 1). If so, it is listed as such on the KEY column. If a dedicated command key is provided on keyboard 200, it is indicated by a dash in the KEY column. It can be seen that under the set and reset columns, some of the lines have a term such as EXECUTE which means that the function listed in the FUNCTION column is immediately carried out when the EXECUTE key is pushed. Other lines, in the set and reset columns, simply have an X. This means that the keying in of the function at the manager's console simply has the result of storing a flag in the appropriate register at the addressed score processing unit.

A function such as the function for paging messages is carried out as follows. A lane, for example lane 5, is designated. The appropriate paging message, which may be "call extension 234" is typed on the keyboard, as the keyboard has been enabled by pushing the page key on the function keyboard. The paging message is displayed in replacement of the top row of data which would otherwise appear on the screen in the locations corresponding to the locations where it will appear at the designated lane. This is accomplished simply by storing it in the appropriate locations in the visible portion of the random access memory 44. When the message is completely typed in, the EXECUTE key is pushed and the program transmits a pointer which points at the location in the visible random access memory of the addressed lane score processor corresponding to the location where the first character of the paging message is to be stored in the visible RAM 44V. The command which follows is to store the succeeding data words in the register pointed at, and that the address stored in the pointer register at the lane is to be incremented after each data word is stored until the entire paging message has been stored in the appropriate locations in the visible random access memory. As the message is stored in the visible portion 44V of the lane scorer's random access memory 44, the message is displayed at that lane scorer on the monitor 24L or 24R. The manager's console can eliminate the paging message by the manager pushing the lane number, the RESET key, the PAGE key and the EXECUTE key which will cause a pointer register address again corresponding to the first location in random access memory now holding the paging message to be pointed at. The command now sent is to replace the paging message with the heading which normally appears in row 1 and which can be found in a dedicated stack of locations at the manager's console RAM 44. The program moves each of these stored pieces of data back into the visible random access memory, and the normal display is restored.

Finally, as shown in the LIST column of FIG. 7, most functions commanded from the manager's console, a list appears on the manager's console monitor 24 of the lanes to which the command is directed or which are currently in the state specified.

The program for controlling operations at the manager's console is included in the file of application Ser. No. 764,366 at Appendix A. It is in the standard programming format used for the Motorola MC6800 8-bit processor. The left-hand column is a line number for each instruction. The next listing on each line consists of the address in memory in hexidecimal code of the operation code of the next succeeding instruction. The third column includes two alphanumerics which are the hexidecimal representations of the operational code. The next column includes four alphanumerics which are the hexidecimal representation of the memory address associated with the operational code; that is, the storage location of the data to be operated on.

The next two columns are a short-hand representation of the operational code defined in hexidecimal in column 3, and the memory address of the data to be operated on defined in hexidecimal notation in column 4.

Thus, referring to the program used to transfer the display at a lane monitor 24L or 24R to the manager's console monitor 24, the DISPLAY PROCESSOR routine appears on pages 21 and 22. The instruction at line 726 transmits to the appropriate lane score processing unit the address of the lane whose display is to be shown at the manager's console. The instruction at line 746 is a reset code sent to all lane score consoles to disconnect their video output ports from the video out bus 8. In the instruction at line 755, the most significant half of the address of the PIA register is sent to the pointer register of the addressed score console. Each lane score unit has a separate PIA register for the left and right side CRT displays 24L and 24R. Therefore, the least significant half of the address must tell the microprocessor at the score console exactly which PIA is associated with the video display whose display is to be transferred. Thus, instructions 776 and 770 are provided to transmit the least significant half of the address to the pointer register, designating the left or right side PIA register. At 772, the command word is transmitted; that is, to set the bit in the PIA register addressed by the pointer register. At 774, the data code is transmitted which designates exactly which bit is to be set in the addressed PIA register. The necessary information having been assembled, at 779 the subroutine is called which transmits the command words over the command bus to the addressed score console.

As disclosed above, a command to transfer both displays at a single lane score console will result in cutting off all video and displaying the video from the manager's console. Obviously, the same pair of commands to set bits in registers VL, VR at the manager's console will cause the display on monitor 24 of the incoming video transferred from a designated lane.

Certain routines are supplementary to the LANE DISPLAY subroutine specifically discussed. They are also included in Appendix A, and are briefly discussed below.

The listing at pages 1–4 is the registers in the random access memory where data is stored. This list on page 4 is the addresses of the registers in the peripheral interface adapters which may be selectively addressed by the microprocessor. At pages 6 and 7, is the program interrupt which occurs every 8 milliseconds for reading the control registers, decrementing the counters, and flashing lights to indicate that the manager's console is available for accepting a command. At page 8 is the subroutine for polling the keyboard. The keys of the keyboard are connected to ports of the PIA which are energized to determine if a circuit has been closed through one of the keys. If the same key remains depressed through a number of interrupts, then it is determined to have actually been closed and debounced, and the character is stored.

Page 9 discloses the keyboard polling subroutine which determines beginning at line 338 whether a numeric, alphabetic or command key has been depressed (line 338, TBLPNT).

Various branches occur, depending on whether a numeric, alphabetic or control key is depressed. Referring to page 10, if a numeric key is depressed, indicating a lane selection, then this lane number is displayed (line 345) on monitor 24. If an alphabet key is depressed to input information, this is also displayed on the monitor 24 (line 347). If a control key is depressed at address 20E9, a control flag is set, followed by a jump to the subroutine on page 19. Pages 19 and 20 comprise a subroutine for determining what code has been commanded by the command key which has been depressed; this is followed by branches to the pertinent subroutines to implement that code (address 2375).

Pages 17 and 18 are simply a start-up routine for resetting all the registers. Page 16 is the branch routine for the numeric keystrokes that turn on lights when the execution is completed.

Page 24 is a conversion subroutine to provide the BCDBIT which is used to address a selected lane score console unit. Pages 25 and 26 are the subroutine which comprises means for transmitting an address code (OUTXNT). This subroutine includes means for checking that an addressed unit recognizes its address (24EC) and, if not, retransmitting the code (2500). Every lane score processing unit 10, 12, 14 receives the address code and by comparison with identity switches 140, determines that it is the one being addressed. Such comparison routines are well known in the art. See e.g., the listing on page 27, addresses 2571–2577, an address comparison subroutine for checking to determine that the score console next to be addressed in a sequence is not outside the desired range.

At page 27 are provided two subroutines, step to next monitor and roll display processor, the first of which automatically steps the addresses by increments of one at two second intervals (2562) so that a range of score consoles (e.g., lanes 1–10) are successively addressed. The second is a procedure for manual incrementing by one through the listed range (258C) with each depression of the N key so that a single lane monitor's display may be maintained on the manager's console monitor for as long as desired.

Page 28 is the related subroutine for executing a function over a range. At address 25AA the first numeric is stored, and at 25BO the bottom address is zeroed. At 25B8, a flag is set to indicate to the processor that it will be working over a range. At 25C2, a display text order is issued so that the message appears on the screen to enter the other end of the range. The other end of the range is read as the first step of any control subroutine which is entered by pushing the command key on keyboard 200. This control subroutine will take the content of the BCD register which is loaded with the bottom end of the range, and put it in the range register. The data at lines 1059-1062 is the text which must be stored so that it can be displayed when called.

At page 30 is the block processing routine which is needed to execute the same function at each address over a range and includes as significant steps therein at address 2616 resetting the abort flag to cover the possibility that there may have been a failure to execute an instruction; at 261E adding one to the last address used, at 2627 getting the top address of the range, and at 262A and following, comparing the incremented address to the new address. If the signal has exceeded the top of the range, then at 2632 a roll flag is set to prevent further steps. At 264A, the conversion is made to provide an address capable of display to indicate on the manager's monitor 24 the lane now being addressed.

At page 31 is the standard sequence which is followed when a command is not being executed, which at address 2676 inquires if the manager's console should be in the print mode, and at 2679 successively addresses all the units 10, 12, 14 connected to the manager's console 1 to determine if someone tried to clear a lane score unit or remove a score. The timer is set (2681) to limit the time in which some unit must answer. If such an action did occur, then an interrupt is set (268F), and the unit address is displayed.

Thus, by use of the disclosed system and its software, addressable video transfer communication is provided between the manager's console and the lane score processing units.

I claim:

1. In an automatic bowling scoring system for use with a plurality of bowling lanes wherein a manager's console unit is employed for asserting selective control over at least a video display portion of the scoring system, the combination comprising a manager's console unit, a plurality of lane score console units, each of said console units comprising a keyboard for providing input information, memory means coupled to said keyboard for storing at least bowler, lane, and game information, a processing unit coupled to said memory means for processing at least said input and stored information, a CRT monitor for displaying at least bowler identification, lane, and game score information, and a video display controller coupled to said memory means and said CRT monitor for controlling information displayed on said monitor, a plurality of communication buses for connecting said manager's console and said lane score console units in parallel, an interface unit for each said manager's console and lane score console units for selectively connecting the video display controller of each one of said lane score console and manager's console units to its respective CRT monitor and to said communication buses, each one of said interface units being operable in response to command signals from the manager's console unit to selectively cause display at its respective console unit of video information coupled from its respective console unit or coupled from at least one other of said console units that it is connected to over said buses.

2. The combination claimed in claim 1 wherein, all of the video display controllers and interface units of said lane score console units are operable in response to commands from the manager's console unit to simultaneously receive and couple to their respective CRT monitors video information from the manager's console unit.

3. The combination claimed in claim 1 wherein, each of the interface units of said lane score console units is operable in response to commands from the manager's console unit to couple to its respective CRT monitor video information from its respective video display controller.

4. The combination claimed in claim 3 wherein, the video information from the respective video display controller is taken from the memory means of that lane score console unit, and further including means responsive to commands from the manager's console unit for coupling video information from said manager's console unit and storing it at designated locations in the memory means of selected lane score units.

5. The combination claimed in claim 1 wherein said processing units, said video display controllers and interface units of said lane score console units are selectively operable in response to commands from the manager's console unit to couple video information from a selected lane score console unit to the manager's console unit.

6. The combination claimed in claim 1 wherein the video display controller and interface unit of the manager's console unit are operable in response to commands from the manager's console unit to selectively couple video information to its respective CRT monitor from a selected lane score console unit or from its own console unit.

7. A bowling scoring system for a plurality of pairs of bowling lanes, including a manager's console unit comprising a keyboard for providing input information, memory means coupled to said keyboard for storing at least bowler, lane, and game information, a processing unit coupled to said memory for processing said input and stored information, CRT monitor for displaying at least said bowler identification, lane, and game score identification, and a video display controller coupled to said processing unit and memory means and to said CRT monitor for coupling information to be displayed on said monitor, a plurality of lane console units each comprising a keyboard for providing input information, memory means coupled to said keyboard for storing bowler, lane, and game information, a processing unit coupled to said memory for processing said input and stored information, a pair of CRT monitors for displaying bowler identification, lane, and game score information relating to a respective pair of bowling lanes, and a video display controller coupled to said processing unit and memory means and to said CRT monitor for coupling information to be displayed on said monitor, a plurality of communication buses for connecting said manager's console and said lane score console units in parallel, an interface unit for each of said manager's console and lane score console units for connecting said CRT monitors and video display controllers of said lane score console units in parallel with the manager's console unit over said buses, each of said interface units including one or more local monitor output ports for connecting video signals to a respective one or more CRT monitors, first video input port means for receiving video signals from another console unit, video output port means for coupling video signals to another console unit, additional video port means for receiving video signals from the local console unit, command port means for receiving command signals, and video selective gate means responsive to command signals emanating from said manager's console unit for selectively controlling the coupling of video signals from said lane score console unit or the manager's console unit to the CRT monitors of the lane score console and manager's console units.

8. The combination claimed in claim 7 wherein said command signals emanating from the manager's console are coupled to the processing unit of a selected one or more lane score console units to control the interface unit of said selected one or more console units to select for CRT monitor display either lane score console unit video information or manager's console unit video information.

9. The combination claimed in claim 8 wherein each lane score console unit includes register means addressable by said memory means of the lane score console processing unit in response to commands from said manager's console unit for storing a bit signal, first and second control lines carrying control signals to said gate means, the state of said control lines being controlled by said register means, said control signals being coded for causing said gate means to selectively pass video information from the inputs of said gate means in the interface units to said bus that is connected to the manager's console unit.

10. A system as claimed in claim 9 comprising exclusive gate means included in said video selective gate means and responsive to a coded condition of said control signals from said register means to interrupt any output from said video output port means except in the presence of only one of said command signals.

11. A scoring system as claimed in claim 10 including a bus connecting said manager's console to an input port of said lane score processing unit, said video selective gate means including additional gate means for passing a video signal from said manager's console unit to each of said CRT monitors at a lane scoring console unit, said additional gate means being responsive to said control signals to cut off said video information from said video display controller from said local monitor video output port means and for concurrently applying said video information from said first video input port means to said additional video port means.

12. The combination claimed in claim 11 and including means for selectively transferring designated information from the memory means in the manager's console unit over one or more of said buses to the memory means of one or more selected ones of the lane score console units, and for selectively transferring designated information from the memory means of a lane score console unit over one or more of said buses to the memory means of the manager's console unit.

* * * * *